United States Patent [19]

Parrott

[11] Patent Number: 4,752,863

[45] Date of Patent: Jun. 21, 1988

[54] LIGHT APPARATUS FOR USE WITH A WALL MOUNTED MIRROR

[76] Inventor: Victor E. Parrott, Rte. 7, Box 374, New Castle, Pa. 16102

[21] Appl. No.: 49,340

[22] Filed: May 13, 1987

[51] Int. Cl.[4] ..... F21V 33/00; A47B 97/00

[52] U.S. Cl. ..... 362/128; 312/224; 362/135; 362/147

[58] Field of Search ..... 312/223, 224, 225, 226, 312/227; 362/128, 133, 135, 147, 364

[56] References Cited

U.S. PATENT DOCUMENTS

| | | | |
|---|---|---|---|
| D. 170,159 | 8/1953 | Levin | D4/2 |
| D. 267,515 | 1/1983 | Knabele | D26/58 |
| D. 275,611 | 9/1984 | Wilbert | D26/58 |
| 1,680,062 | 8/1928 | Newton | 362/135 |
| 1,805,847 | 5/1931 | Reetz | 362/133 |
| 2,198,077 | 4/1940 | Curtis | 362/133 |
| 2,418,225 | 4/1947 | Gross et al. | 362/133 |
| 2,422,847 | 6/1947 | Peter | 362/133 |
| 2,927,198 | 3/1960 | Trott | 362/128 |
| 3,081,397 | 3/1963 | Tantillo et al. | 362/133 |
| 3,684,344 | 8/1972 | Gilinger | 312/224 |
| 3,780,281 | 12/1973 | Ohlhauser et al. | 362/128 |
| 4,333,128 | 6/1982 | Moore | 362/140 |

FOREIGN PATENT DOCUMENTS

| | | | |
|---|---|---|---|
| 2053533 | 3/1972 | Fed. Rep. of Germany | 312/224 |
| 1101666 | 10/1955 | France | 362/135 |
| 637001 | 5/1950 | United Kingdom | 362/135 |

OTHER PUBLICATIONS

Universal-Rudle brochure "Medicine Cabinets, Mirrors, Light Fixtures", 4 pages.

Aristakraft brochure "Aristokraft Vanity Cabinets", 4 pages.

Kent brochure "Kent the Quality Difference", 36 pages.

Nutone House Group brochure-"Nutone Products Guide", 1985, pp. 12-28 and 98-101.

*Primary Examiner*—George L. Walton

*Attorney, Agent, or Firm*—Birch, Stewart, Kolasch, & Birch

[57] ABSTRACT

A light apparatus consisting of a cover, light source and activation device provides for greater illumination in the area of a wall mounted mirror. The cover is pivotable between a closed and open position. When in the open position the activation device will cause illumination of the light source. When the cover is in the closed position, the activation device will turn off the light source. In the closed position, the cover hides the light source and activation device from view. The light source may be either mounted on or movable with the cover or may be mounted stationarily within a housing. The light apparatus may be mounted beneath a mirror or on each side of the mirror. Additionally, the light apparatus may be built into the wall or may be mounted on the wall upon which the mirror is mounted. This light apparatus provides for additional illumination which may be used in shaving, applying makeup, or any other task involving a wall mounted mirror.

17 Claims, 5 Drawing Sheets

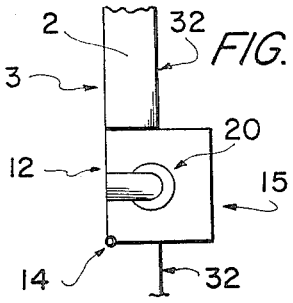
FIG. 10
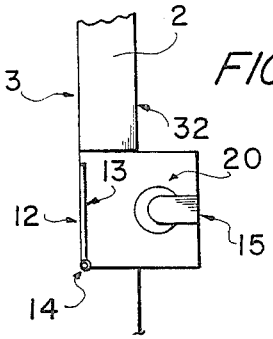
FIG. 11
FIG. 12
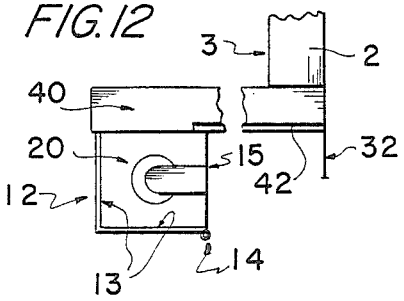
FIG. 13
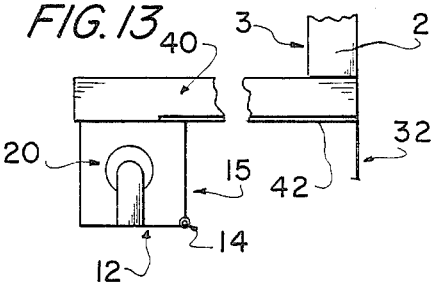
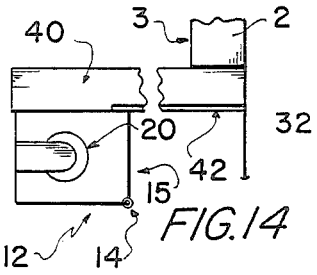
FIG. 14
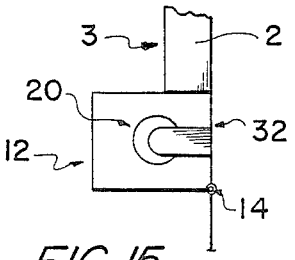
FIG. 15
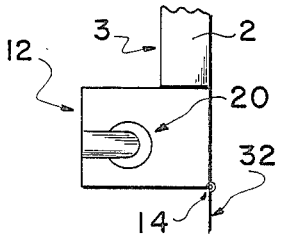
FIG. 16
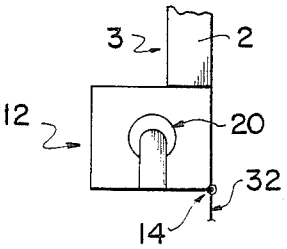
FIG. 17

LIGHT APPARATUS FOR USE WITH A WALL MOUNTED MIRROR

BACKGROUND OF THE INVENTION

The present invention relates to a light apparatus for use with a wall mounted mirror. This light apparatus may be used in a bathroom, dressing or other area. Several embodiments are disclosed with lights, covers, and activation means for the lights.

DESCRIPTION OF THE BACKGROUND ART

Various lighting arrangements are known for bathrooms and the like. Conventionally, a lighting arrangement is either fixed above or at the sides of a wall mounted mirror. These lights are generally exposed at all times. In the design of many modern bathrooms, the lighting provided is not very bright due to aesthetic considerations. As these lights are usually above a user's head, light is directed downwardly. This arrangement creates various problems. For instance, it is difficult to see beneath a person's chin when shaving. This is especially problematic when the shaver is an older person and has wrinked skin. Also, a person wearing glasses or bifocals also finds it difficult to see beneath his chin when looking at the mirror as glare from the downwardly directed light creates problems. While shaving is one problem encountered in conventional lighting arrangements, other problems arise when applying make-up, putting a contact lens in or other common tasks performed in front of a mirror. Accordingly, a need in the art exists for a simple and effective light apparatus which can be used with a wall mounted mirror. This device should be easy to install and convenient to use.

SUMMARY OF THE INVENTION

Accordingly, it is a primary object of the invention to provide a light apparatus which can be used with wall mounted mirrors.

It is another object of the present invention to provide a light apparatus which provides sufficient light for common tasks such as shaving or applying make-up.

It is a further object of the present invention to provide a light apparatus which is easy to operate and inexpensive to install.

Another object of the present invention is to provide a light arrangement which is integral with a mirrored medicine cabinet provided in a bathroom or dressing area.

It is yet another object of the present invention to provide a light apparatus which can be used with a wall mounted mirror which does not have a medicine cabinet or the like.

A still further object of the present invention is to provide a light apparatus which is either built into the wall or is attached thereto.

It is another object of the present invention to provide a light apparatus that provides for additional shelf space in the area of a wall mounted mirror.

Still another object of the present invention is to provide a light apparatus which is selectively hidden from view by a cover in order to protect the light apparatus and to improve the appearance of the area around a wall mounted mirror.

It is yet another object of the present invention to provide a light apparatus which is highly reliable, requires limited maintenance, is simple to use and is inexpensive to manufacture.

These and other objects of the present invention are filled by providing a light apparatus for use with a wall mounted mirror, said apparatus comprising light emitting means located at a peripheral location with respect to said mirror, a cover movable between an open and closed position, said cover enclosing said light emitting means such that when said cover is in said closed position, said light emitting means is hidden from view, and activation means for activating and deactivatng said light emitting means in response to movement of said cover means.

Further scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 is an enlarged cross-sectional view of a built-in light apparatus of the present invention with the light emitting means attached to the cover;

FIG. 11 is an enlarged cross-sectional view of a built-in light apparatus of the present invention with the light emitting means affixed to the wall;

FIGS. 12 through 14 are enlarged cross-sectional views of the light apparatus of the present invention having a shelf with the light emitting means attached to the wall, the lower portion of the cover and the front portion of the cover, respectively;

FIGS. 15 through 17 are enlarged cross-sectional views of a nonbuilt-in light apparatus of the present invention with the light emitting means attached to the wall, the front section of the cover, and the lower section of the cover respectively.

DETAILED DESCRIPTION OF THE PREFERRED EMBODIMENTS

Figure 1:
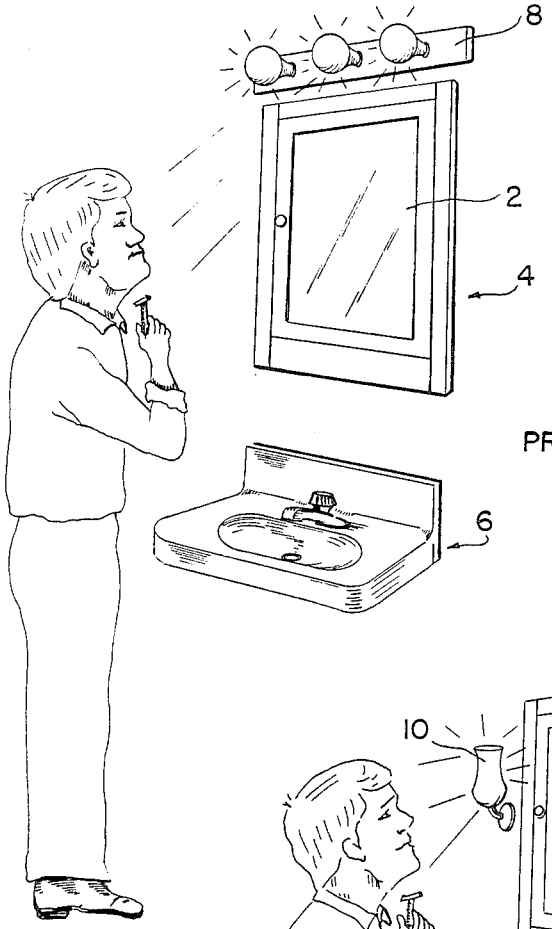
FIG. 1 PRIOR ART
FIG. 1 is a perspective view of a conventional light apparatus located above a wall mounted mirror.
Figure 2:
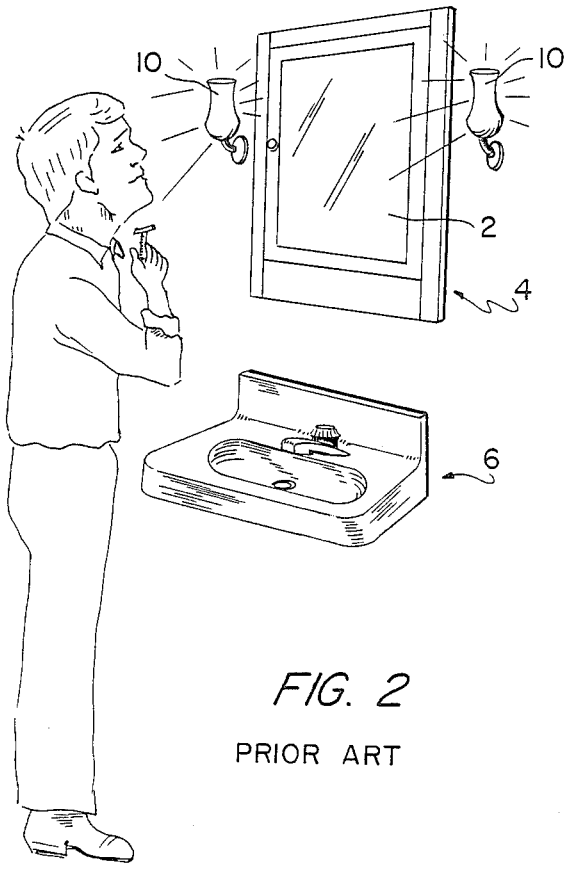
FIG. 2 PRIOR ART
FIG. 2 is a perspective view of a conventional light apparatus mounted at the sides of a wall mounted mirror.

Referring in detail to the drawings and with particular reference to FIGS. 1 and 2, a conventional light apparatus is disclosed. In FIG. 1, a light apparatus 8 is positioned above a mirror 2. In FIG. 2, a light apparatus 10 is positioned at the sides of the mirror. In both arrangements, it can be seen that light generally shines downwardly with respect to a person looking in mirror 2. In such situations, it is difficult to see beneath your chin in order to shave. Also, this situation can be aggravated when wearing glasses or bifocals as glare from the light obstructs vision. Problems are also encountered in these conventional arrangements when applying makeup, putting in contacts and during other common tasks.

In such conventional arrangements, the wall mounted mirror 2 may be integral with a cabinet 4. The wall mounted mirror 2 may also be located above a sink 6.

Figure 3:
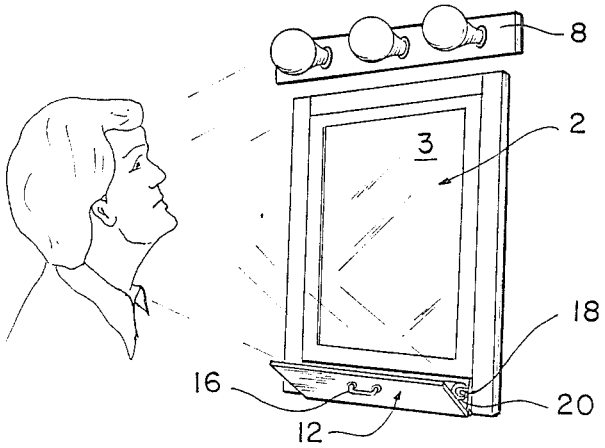
FIG. 3 is a perspective view showing the light arrangement of the present invention located beneath a wall mounted mirror.

In order to overcome the foregoing deficiencies, the present invention provides for an improved light emitting means. As shown in FIG. 3, one embodiment of a light emitting means 20 may be located beneath the mirror. Alternatively, this light emitting means may be located at the sides of a wall mounted mirror 2. Numeral 3 indicates the front face of mirror 2 and will be used to reference this front face throughout the drawings.

Figure 4:
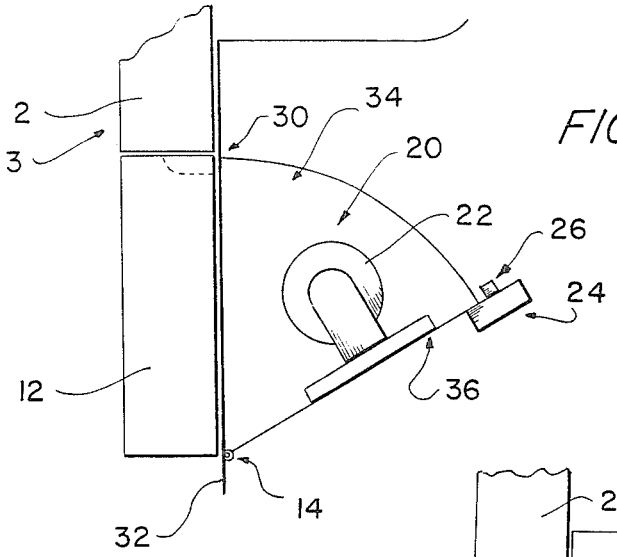
FIG. 4 is a cross-sectional view of FIG. 3 showing the light apparatus of the present invention with a cover in a closed position.
Figure 5:
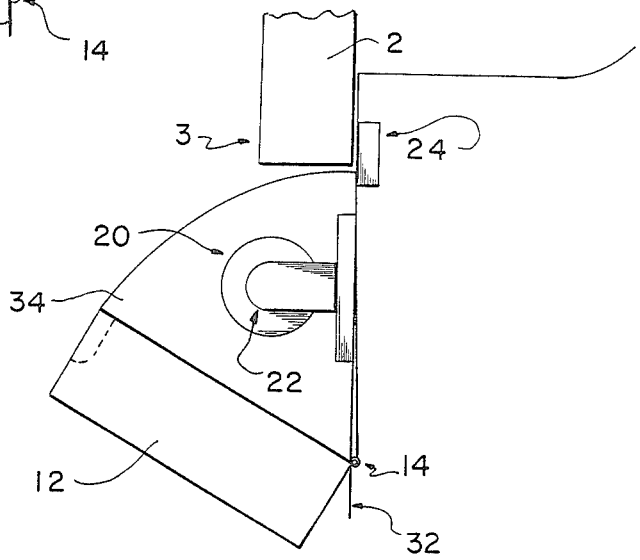
FIG. 5 is a cross sectional view similar to FIG. 4 with the cover in an open position.

Light emitting means 20 consists of a light bulb 22 as indicated in FIG. 4. In the embodiment shown in FIGS. 4 and 5, the light emitting means 20 is mounted on a pivoting panel 36. In front of panel 36, a cover 12 is provided. Panel 36 and cover 12 are interconnected by sidewall 34. Instead of using a sidewall 34 as is shown in FIGS. 4 and 5, a link 18 may be used such as in FIG. 3 or any other conventional connection means between the panel 36 and cover 12 may be used. Such a connection means provides for simultaneous movement of the panel 36 and cover 12.

As seen in FIGS. 4 and 5, panel 36 pivots about hinge 14. When the cover 12 is in the closed position as shown in FIG. 4, the light emitting means 20 and panel 36 are hidden from view from a person standing in front of mirror 2. Thus, a person looking at the front reflective face 3 of mirror 2 would be unable to see light emitting means 22. Accordingly, a more attractive appearance is obtained by using a cover 12. The person standing in front of mirror 2 may then grasp cover 12 by a handle 16, as illustrated in FIG. 3, or by a groove in cover 12 or by any other conventional grasping arrangement or even by mere frictional force along an edge of the cover 12.

When the cover 12 is moved to the open position as shown in FIG. 5, panel 36 pivots about hinge 14. This raises the light emitting means 20 to the exposed position as shown in FIG. 5. When cover 12 pivots to the open position, activation means 24 moves with panel 26. This activation means 24 includes a switch 26 which engages a detent 30. This detent may be the back of the mirror, the wall 32 or any other contact means. When switch 26 engages the detent 30, light emitting means 20 is activated. In other words, when the cover 12 is in the open position and light emitting means 20 is exposed, the light bulb 22 will be activated. Due to the position of this light emitting means 20, light may be directed upwardly so that a person standing in front of mirror 2 will now be in upwardly directed light. This increases the light available for the user and enables a user to better see beneath their chin.

Figure 6:
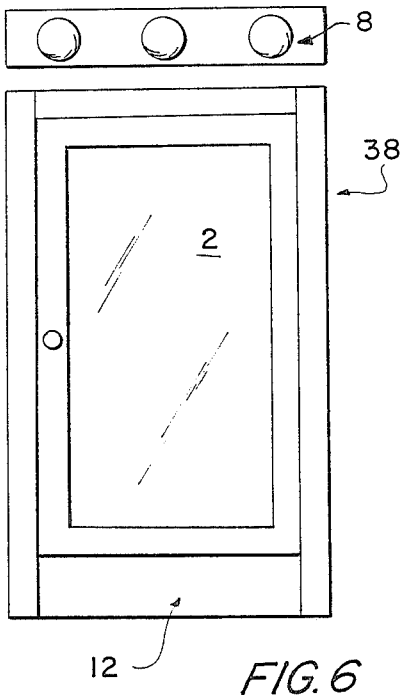
FIG. 6 is a front view of the light apparatus of the present invention with the cover in the closed position.
Figure 7:
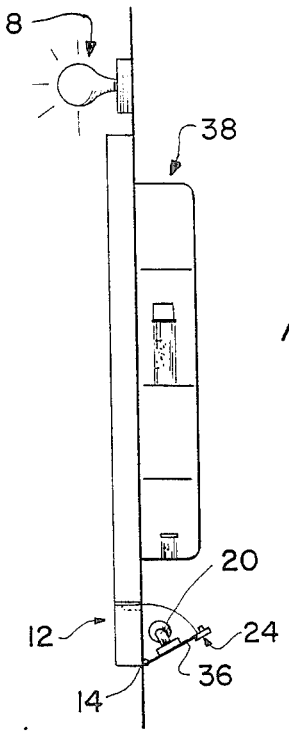
FIG. 7 is a cross-sectional view of FIG. 6 of the light apparatus of the present invention with the cover in the closed position.
Figure 8:
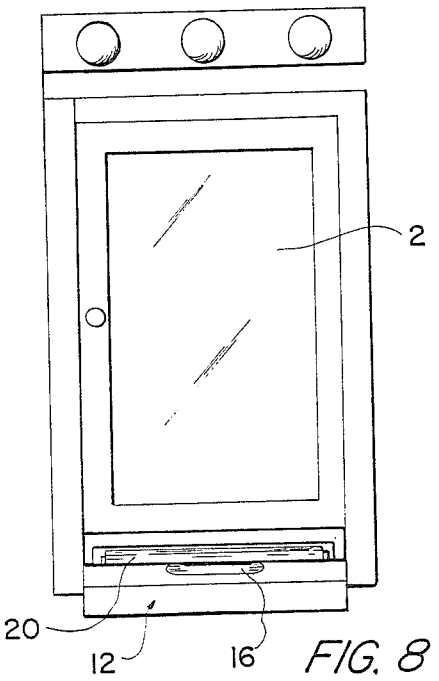
FIG. 8 is a front view of the light apparatus of the present invention similar to FIG. 6 with the cover in the open position.

Referring to FIGS. 6–9, the pivoting cover and panel arrangement are shown in relation to a cabinet structure 38. As seen in FIG. 6, when cover 12 is in the closed position, light emitting means 20 is hidden from view. However, when this cover is moved to the open position of FIG. 8, light emitting means 20 is visible and will emit more light in the area of wall mounted mirror 2. While a fluorescent-type bulb is indicated in FIG. 8 for light emitting means 20, it is contemplated that any conventional lighting means, including an incandescent bulb may be used.

Figure 9:
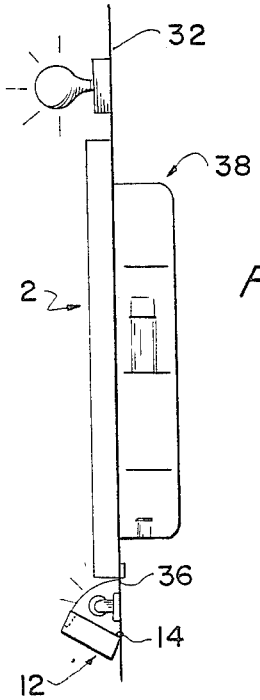
FIG. 9 is a cross-sectional view of FIG. 8 with the cover in the open position.

In FIGS. 7 and 9, the cover is shown in the closed and open position, respectively. FIGS. 7 and 9 indicate the interrelationship of the light apparatus with the cabinet structure 38.

Although FIGS. 6–9 indicate that the light apparatus is integral with the cabinet structure 38, this light emitting apparatus may be provided without an integral cabinet structure. In other words, this light apparatus may be used when there is only a wall mounted mirror. Also, this light apparatus may be built into the wall or mounted on the wall in the vicinity of a wall mounted mirror. Built-in arrangements have the benefit of being more attractive as they are flush with the mirror. It is therefore more difficult to detect that a light apparatus is provided and the appearance of the area around the mirror is improved. However, in order to reduce costs, this light apparatus may merely be mounted on the wall rather than built-in. While it is more apparent that a light apparatus is used in a nonbuilt-in design, the wall mounted arrangements nonetheless provide for an attractive appearance of the area surrounding mirror 2.

Referring now to FIGS. 10 and 11, a built in light apparatus beneath mirror 2 is shown. These light apparatus are somewhat similar to that shown in FIGS. 3–9 except for the fact that a pivoting panel 36 is not used. In FIG. 10, the light emitting means 20 is mounted directly on the cover 12. This cover 12 pivots about hinge 14. The wall 32 on which mirror 2 is mounted has a recess therein for receiving housing 15 of the light apparatus. The embodiment of FIG. 10 includes an activation means (not shown) which may be either mounted on the pivoting cover 12 or affixed to the stationary housing surrounding light emitting means 20. If the activation means were mounted on cover 12, it would operate to turn on light emitting means 20 when the cover 12 is moved to the open position and the activation means encounters a detent on the wall or mirror. If, the light activation means were affixed to the housing which surrounds light emitting means 20, this activation means would also act to turn on light emitting means 20 when cover 12 is moved to the open position and a detent on the cover is encountered. To move the cover 12 to the open position, this cover 12 is merely pivoted counterclockwise (as seen in FIG. 10) about the hinge 14. Stops, links or other means may be provided to enable cover 12 to only pivot less than 90°.

To turn off the light emitting means and to hide it from view, cover 12 is pivoted clockwise (as seen in FIG. 10) about hinge 14 to the closed position. While the activation means has been noted as being interchangeable in position for FIG. 10, any of the disclosed embodiments may have the light activation mounted on either the movable cover or a movable panel (if provided) or affixed to a stationary structure such as the mirror or wall.

In FIG. 11, a light apparatus similar to FIG. 10 is disclosed. This light apparatus however, has light emitting means 20 stationarily mounted on the back wall of housing 15. A reflective surface 13 may be provided on cover 12 such that when cover 12 is moved in a counterclockwise direction about hinge 14 to the open position, light from light emitting means 20 is refelcted upward. It is noted that the light in the areas surrounding mirror 2 would be increased by the light apparatus of FIG. 11 whether or not a reflective surface 13 is used. Thus, this reflective surface is optional. Further, such a reflective surface may be used with any of the disclosed embodiments.

With regard to FIGS. 12–14, a light apparatus is shown wherein a shelf 40 is provided in front of mirror 2. This shelf 40 increases the shelf space around a wall mounted mirror. Often in a bathroom, shelf space is at a premium. Beneath shelf 40, the light apparatus is mounted.

As seen in FIG. 12, the light emitting means 20 is affixed to the stationary backwall of housing 15. An L-shaped cover 12 is provided. This cover 12 has an optional reflective surface 13 thereon. Instead of mounting the light emitting means on the stationary wall of the housing, this light emitting means 20 may be mounted on either side of the pivoting cover 12 as shown in FIGS. 13 and 14.

In FIGS. 12–14, cover 12 is pivotable from a closed to an open position about hinge 14. A locking means (not shown) may be provided for the light apparatus in order to ensure that the cover 12 stays in place when it is moved to the closed position. Also, stop means (not shown) may be provided in order to prevent rotation of cover 12 about hinge 14 beyond a desired angle. A channel 42 is provided beneath shelf 40. This channel 42 permits wiring to run from light emitting means 20 to an appropriate power source.

FIGS. 15–17 show a light apparatus similar to that of FIGS. 10 and 11. This light apparatus, however, in not built-in to wall 32. The light apparatus of FIGS. 15 and 17 is located beneath wall mounted mirror 2. Light emitting means 20 is provided within each apparatus. As seen in FIG. 15, this light emitting means 20 is stationary as it is mounted on the wall 32. Alternatively, a stationary housing structure may be provided between this light emitting means 20 and wall 32. Cover 12 is pivoted about hinge 14 such that when the cover is in the open position, light emitting means 20 is visible and will be activated. When this cover 12 moves to the closed position, the light emitting means 20 will be hidden from view and will be turned off. As seen in FIGS. 16 and 17, this light emitting means 20 may be movable with the cover 12. The covers 12 of FIGS. 16 and 17 are pivotable about hinge 14. All arrangements of FIGS. 15–17 provide for the light emitting means 20 to be hidden from view when the cover 12 is in the closed position.

With regard to FIGS. 18–23, a wall mounted light apparatus is disclosed. Instead of being positioned beneath wall mounted mirror 2, the light apparatus are located on each side of mirror 2. A front face 3 is provided for each mirror 2. Each of the light apparatus are provided with covers 12 which are pivotable about hinge 14.

Figure 18:
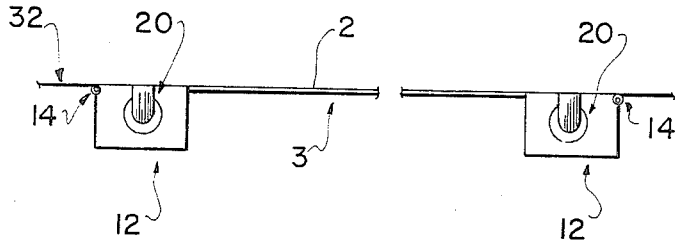
FIGS. 18–23 are top cross-sectional views of the light apparatus mounted on the sides of a wall mounted mirror of the present invention showing a light emitting means affixed to the wall in a built-in and nonbuilt-in apparatus, a light emitting means affixed to the side of the cover in a non-built in apparatus, a light emitting means attached to the front of a cover in a built-in and nonbuilt-in apparatus and a light emitting means attached to a pivoting panel, respectively.

In FIG. 18, a nonbuilt-in light apparatus is shown. The left hand cover 12 of FIG. 18 will move clockwise about hinge 14 to an open position. The right hand cover 12 of FIG. 18 will move conterclockwise about hinge 14 to reach the open position. Both covers may be pivoted independently. When a cover is moved to the open position, the activation means (not shown) will cause light emitting means 20 to be illuminated.

Figure 19:
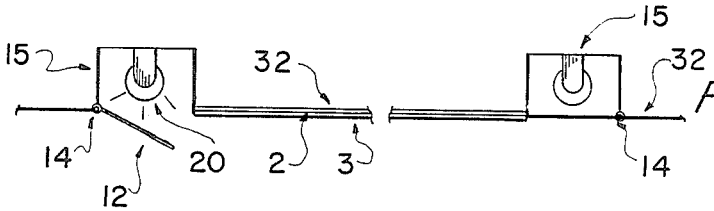

FIG. 19 shows a light apparatus similar to that of FIG. 18. However, this light aparatus is built into wall 32. The right hand cover 12 of FIG. 19 is shown in a partially opened position while the lefthand cover 12 is shown in a partially opened position. Reflection surfaces (not shown) may be provided on each of the covers to increase available light in front of mirror 2. When the covers 12 are in the closed position, their faces will be substantially flush with the face 3 of mirror 2.

Figure 20:
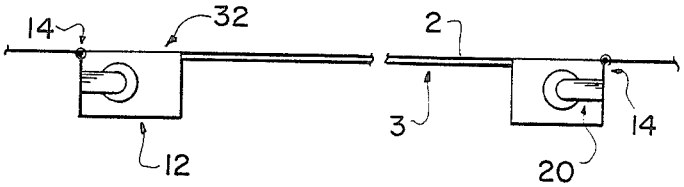
Figure 21:
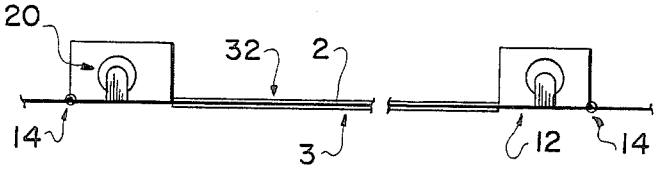

FIG. 20 shows a light apparatus similar to that of FIG. 18. However, each light emitting means 20 is mounted on and movable with covers 12. Similarly, in FIG. 21 a movable light emitting means 29 is provided for the built-in light apparatus. The built-in light apparatus arrangements provide for a surface of the cover to be substantially flush with the face 3 of mirror 2 when in the closed position.

Figure 22:
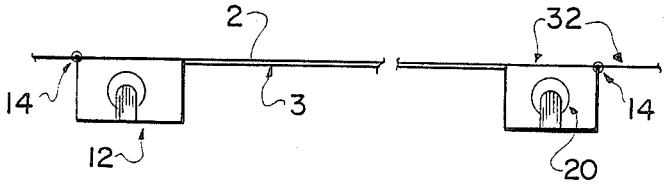
Figure 23:
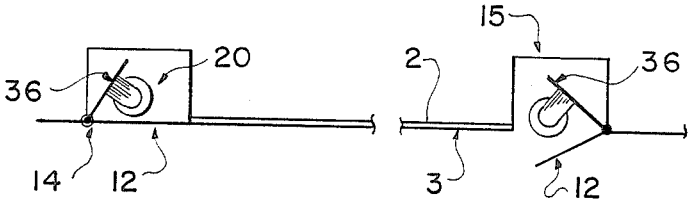

FIG. 22 shows a light apparatus similar to that of FIG. 20. Instead of mounting the light emitting means 20 on a side of the cover 12, this light emitting means is mounted on the back of the face of cover 12. In FIG. 23, a pivotable light apparatus is disclosed. This apparatus includes a pivoting panel 36. Panel 36 will move simultaneously with cover 12. As seen in FIG. 23, the left hand cover is shown in the closed position while the right hand cover is shown in the partially opened position.

In all embodiments, the light emitting means 20 will be turned off when the cover 12 is in the closed position. When the cover 12 is moved to an open position, this light emitting means 20 will be illuminated. Reflection surfaces 13 may be provided in each of the embodiments. The surfaces are optional and merely increase the illumination in the area of wall mounted mirror 2. Additionally, locking means may be provided on any of the cover arrangements to ensure that the covers remain in their open and/or closed positions and reflective surfaces 13 may be provided on any of the cover arrangements.

In operation, the light apparatus of the present invention will provide more illumination in the area surrounding a wall mounted mirror 2. Upon opening of cover 12, the light emitting means 20 will be activated by the activation means 24. By closing cover 12, the light emitting means 20 will be turned off. This light apparatus of the present invention may be provided beneath a wall mounted mirror 2 or at the sides of a wall mounted mirror 2, or at the sides and the bottom of a wall mounted mirror 2 or even around all sides of a wall mounted mirror 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light apparatus for use with a wall mounted mirror, said apparatus comprising:

light emitting means located at being located at least on opposite sides of said or being located beneath said mirror;

a pivotable cover about an axis movable between an open and a closed position, said cover enclosing said light emitting means such that when said cover is in said closed position said light emitting means is hidden from view; and activation means for activating and deactivating said light emitting means in response to movement of said cover means, said pivotable cover directly uncovers said light emitting means when said cover is moved to said open position thereby allowing light from said light emitting means to be projected directly in front of the mirror, said light being projected at least upwardly or laterally depending on the location of said light emitting means.

2. The light apparatus according to claim 1, wherein said mirror includes a bottom and said cover is located beneath the bottom of the mirror.

3. The light apparatus according to claim 2, wherein said mirror includes a face lying in a plane and said cover generally lying along the plane in which said mirror face is located when said cover is in the closed position.

4. The light apparatus according to claim 2, wherein said mirror has a face lying in a first plane and said cover has a face lying in a second plane, said first and second planes being generally parallel and noncoincident, and further comprising a generally flat surface extending between said first and second planes, said surface being located between said mirror and said light emitting means and being adjacent said cover when said cover is in the closed position.

5. The light apparatus according to claim 4, wherein said flat surface is integral with said cover and movable therewith.

6. The light apparatus according to claim 4 wherein said flat surface forms a stationary shelf.

7. The light apparatus according to claim 1, wherein said mirror includes two side portions and wherein two lighting apparatus are provided, one at each side portion of said mirror.

8. The light apparatus according to claim 7, wherein said light emitting means is attached to said cover and movable therewith.

9. The light apparatus according to claim 7, wherein said cover includes a face generally lying in a first plane and said mirror includes a front face generally lying in a second plane, said first and second planes being generally parallel and noncoincident when said cover is in said closed position.

10. The light apparatus according to claim 7, wherein said cover includes a face and said mirror and said cover face generally lie in the same plane.

11. The light apparatus according to claim 1, wherein said activation means is located on said cover and is movable therewith, said activation means comprising a switch which is engageable with a detent when said cover is in the open position, said detent being fixed relative to the mirror, engagement of said switch with said detent causing activation of said light emitting means.

12. The light apparatus according to claim 1, wherein said activation means is fixed relative to said mirror, said activation means includes a switch which is engageable with said cover when said cover is in the closed position, engagement of said switch with said cover causing activation of said light emitting means.

13. The light apparatus according to claim 1, wherein said light emitting means is affixed to said cover and is movable therewith.

14. The light apparatus according to claim 13, wherein said activation means is located on said cover and is movable therewith, said activation means comprising a switch which is engageable with a detent when said cover is in the open position, said detent being fixed relative to the mirror, engagement of said switch with said detent causing activation of said light emitting means.

15. The light apparatus according to claim 13, wherein said activation means is fixed relative to said mirror, said activation means includes a switch which is engageable with said cover when said cover is in the closed position, engagement of said switch with said cover causing activation of said light emitting means.

16. The light apparatus according to claim 1, wherein said light emitting means is affixed to a movable panel, said panel being associated with said cover to move simultaneously therewith and said light emitting means being located between said panel and said cover.

17. The light apparatus according to claim 1, wherein said mirror is integral with a cabinet structure and said light apparatus is also integral with the cabinet structure.

* * * * *